US006050033A

United States Patent [19]

Wrightman

[11] Patent Number: 6,050,033

[45] Date of Patent: Apr. 18, 2000

[54] BOLTED POST AND BEAM

[76] Inventor: Ronald A. Wrightman, Box 25, 1 Kevin Crescent, Bracebridge, Ontario, Canada, P1L 1A7

[21] Appl. No.: 08/881,185

[22] Filed: Jun. 24, 1997

Related U.S. Application Data

[63] Continuation-in-part of application No. 08/797,642, Jan. 31, 1997, abandoned.

[51] Int. Cl.[7] ..... E04B 7/06

[52] U.S. Cl. ..... 52/93.1; 52/92.1; 52/127.7; 52/586.2; 52/656.9; 403/13; 403/292; 403/408.1

[58] Field of Search ..... 52/92.1, 92.3, 52/93.1, 93.2, 127.7, 127.8, 233, 283, 289, 586.2, 589.1, 590.1, 590.2, 639, 641, 648.1, 650.1, 650.2, 656.1, 659.9; 403/13, 231, 245, 292, 297, 374, 405.1, 408.1, 409.1

[56] References Cited

U.S. PATENT DOCUMENTS

| | | | |
|---|---|---|---|
| 368,844 | 8/1887 | McCormick . | |
| 444,604 | 1/1891 | Baker . | |
| 907,554 | 12/1908 | Ansbach . | |
| 1,294,115 | 2/1919 | Knight . | |
| 1,378,448 | 5/1921 | Gilbert . | |
| 2,287,454 | 6/1942 | Scharnberg . | |
| 2,390,180 | 10/1945 | Sahlberg . | |
| 2,747,638 | 5/1956 | Cederquist . | |
| 3,601,939 | 8/1971 | Clyne et al. . | |
| 4,261,665 | 4/1981 | Hsiung | 403/231 |
| 4,391,077 | 7/1983 | Giess . | |
| 4,409,763 | 10/1983 | Rydeen . | |
| 4,599,837 | 7/1986 | Wrightman . | |
| 4,728,215 | 3/1988 | Martincic et al. . | |
| 4,815,242 | 3/1989 | Gilliland . | |
| 4,823,519 | 4/1989 | Gilliland . | |
| 4,883,383 | 11/1989 | Challis . | |
| 4,981,388 | 1/1991 | Becken et al. | 403/258 |
| 5,020,289 | 6/1991 | Wrightman . | |
| 5,468,086 | 11/1995 | Goya . | |

*Primary Examiner*—Carl D. Friedman
*Assistant Examiner*—Kevin D. Wilkens
*Attorney, Agent, or Firm*—Ladas & Parry

[57] ABSTRACT

A post and beam building structure has structural members connected by threaded fasteners. The fasteners extend along the axis of the structural members and project into a transverse bore where they are secured with a nut. Manufactured logs are secured to the posts with oppositely directed keyhole shaped wedges that are located in aligned recesses in the post and end face of the log.

19 Claims, 7 Drawing Sheets

BOLTED POST AND BEAM

This is a continuation-in-part application of application Ser. No. 08/797,642 filed Jan. 31, 1997, now abandoned.

BACKGROUND OF THE INVENTION

1. Field of the Invention

The present invention relates to building structures and in particular to such structures using post and beam construction.

2. Description of the Prior Art

Post and beam construction is a well-known type of building structure in which loads are transferred through horizontal beams to vertical posts secured on a suitable foundation. Wall structures between the posts may then be of a non-load bearing type. Such a technique requires relatively large structural components which traditionally have been prepared and assembled on site. Typically, the posts and beams are connected using traditional joints such as mortice and tenon, and therefore the construction of a post and beam structure has been labour intensive and required a high skill level. However, the aesthetic appeal of the relatively large section timbers utilized in post and beam construction and the flexibility they provide within the building envelope has maintained the popularity of the structures for custom building.

There have been some proposals to utilize bolted structures in place of the traditional joints but these have tended to be aesthetically unattractive and also have not utilized the inherent strength of the timber to its best advantage.

Many such proposals, as typified by U.S. Pat. No. 1,378,448 to Gilbert, utilize bolts to interconnect the trusses through bracing members. The bolts extend transversely to the structural member so that the bracing member is out of the plane of the structural members and the bolts are exposed. Moreover, the bolts extend across the grain adjacent an end of the structural member which is generally undesirable.

Similarly, in U.S. Pat. No. 2,390,180 to Sahlberg, bolts are utilized to interconnect the post and beam to a reinforcing fillet. While the bolts lie in the plane of the post and beam member, they nevertheless extend transversely through the structural member and require the provision of the internal fillet.

U.S. Pat. No. 3,368,844 to McCormick shows a truss structure in which the post and beam are connected at doweled joints. A bolt is provided to inhibit relative rotation between the rafter and the post but is spaced from the joint and transverse to the grain of the structural members to impose significant bending loads on the structural members.

The prior proposals do not provide a post and beam construction that facilitates assembly of such structures and maintains their aesthetic appeal while at the same time utilizing improved construction techniques.

SUMMARY OF THE INVENTION

In general terms, therefore, one aspect of the present invention provides a post and beam building structure in which a pair of structural members are interconnected by a threaded fastener that extends along the longitudinal axis of at least one of the structural members. The threaded fasteners terminates intermediate the ends of the one structural member in a transverse bore which provides access to the threaded fastener and house a threaded retainer. Axial loads can then be applied to the fastener to secure the two members to one another.

Preferably the other of the structural members is formed with a notch to support the end of the one structural member in transverse loading.

As a further preference, annular split rings are interposed between abutting ends of the structural members. Such rings extend across the junction between the two members and one of the members has a recess to accommodate the split ring. A biasing member is located within the recess to bias the split ring toward the other member and maintain it in position bridging the two members after assembly.

A further aspect of the present invention provides for connection of horizontally stacked wall members between adjacent posts. The wall members are typically referred to as "logs" and a key extends between the ends of the logs and a vertical surface of the post. The key has a pair of re-entrant formations interconnected at a waist that is positioned at the junction between the wall members and the post. The key member includes a pair of components that may slide relative to one another along an inclined plane to thereby vary the lateral dimension of the key member and effectively secure it within complementary shaped recesses in the post and log.

BRIEF DESCRIPTION OF THE DRAWINGS

An embodiment of the invention will now be described by way of example only with reference to the accompanying drawings, in which.

DESCRIPTION OF THE PREFERRED EMBODIMENTS

Figure 1:
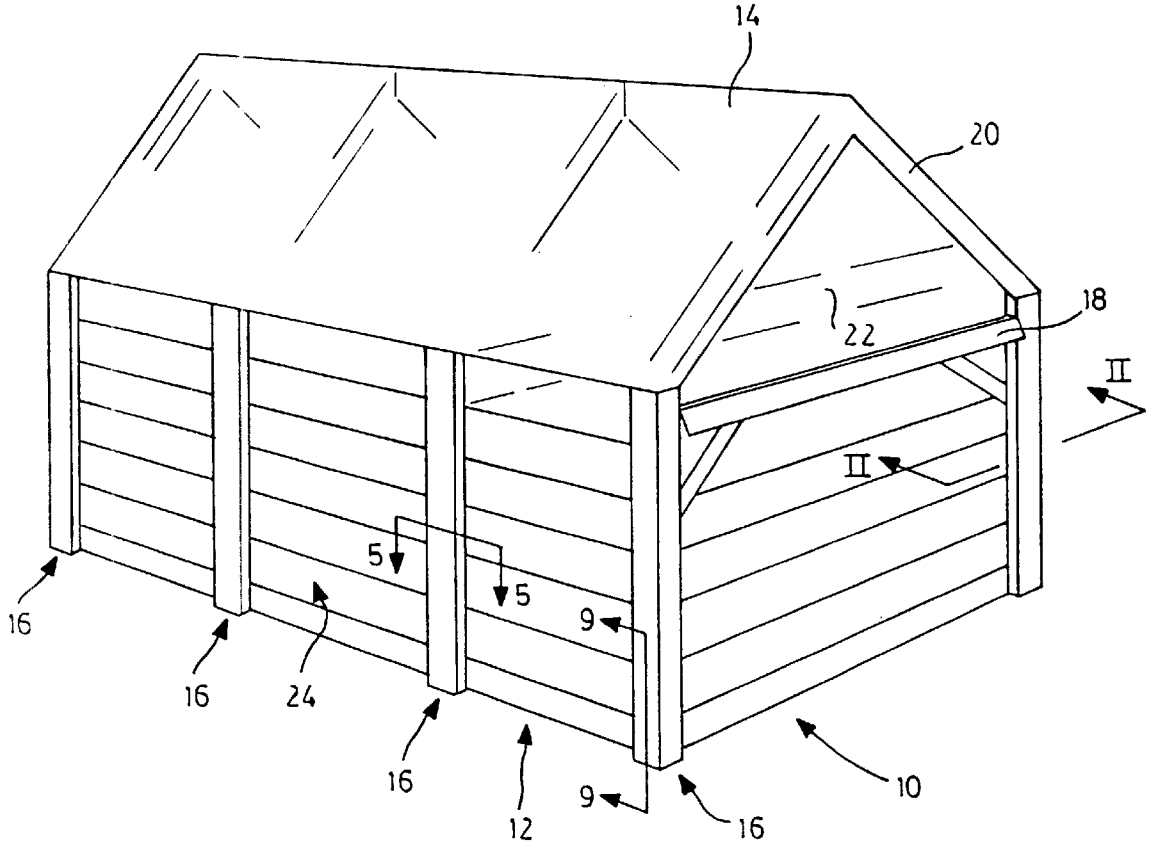
FIG. 1 is a general perspective view of a building structure.

Referring therefore to FIG. 1, a building structure generally indicated at 10 includes a plurality of walls 12 and a pitched roof 14. It will be appreciated that the exact form of the structure shown is by way of example only and more complicated building structures are contemplated within the scope of the present disclosure.

Figure 10:
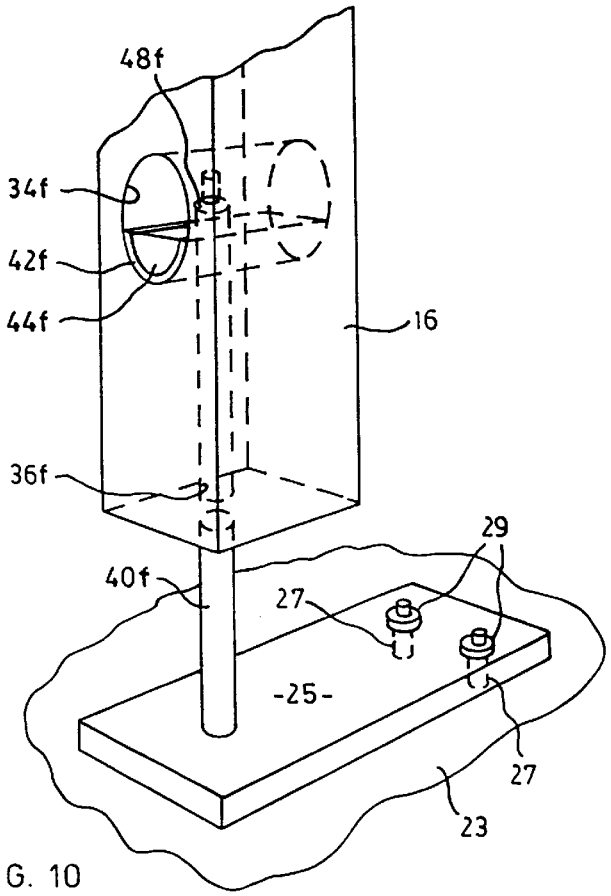
FIG. 10 is an exploded perspective view of the portion of the wall shown in FIG. 9.

The structural components of the building 10 include vertical posts indicated generically at 16 and horizontal beam members 18 that are connected to the posts 16 in a manner to be described below. The structural components also include rafters 20 that act as inclined beams to transfer vertical loads to the posts 16 and cross ties 22 extending between the rafters 20. It will be appreciated that the vertical loads imposed upon the beam structures 18, 20, 22 are transferred into the vertical posts 16 and onto suitable foundations 23 as shown in FIG. 10. The posts 16 are secured to the foundation 23 by plate 25 bolted to the post 16 and foundation 23 as will be described below.

The posts 16 are spaced at suitable intervals and the walls 12 completed by horizontally stacked logs 24. As an alternative to the logs 24, conventional framed panels may be provided between the posts 16 but the logs have been illustrated to show further aspects of the present invention.

As can be seen from FIG. 2, the posts 16 and beam structures 18, 20, 22 are connected to one another using similar techniques and accordingly one connection will be described in detail and the other connections used to indicate variations. The vertical post 16 horizontal beam 18 intersect at right angles. The post 16 has a notch 26 formed adjacent one end with a horizontal shoulder 28 and an inclined beveled face 30. Beam 18 has an end face 32 that is beveled at an angle corresponding to the bevel face 30 and therefore is snugly received in the notch 26.

Figure 4:
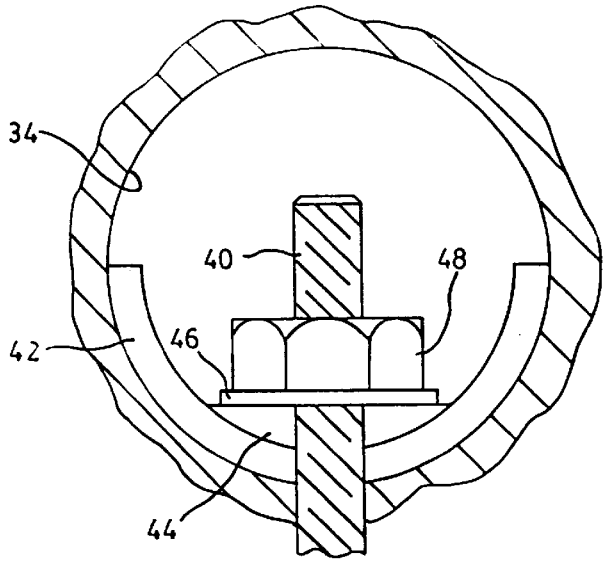
FIG. 4 is an enlarged view of the portion of the structure shown in FIG. 2 identified by the arrow IV.

The beam 18 has a transverse bore 34 which intersects a longitudinal bore 36 that extends from the end face 32 parallel to the longitudinal axis of the beam 18. A transverse bore 38 in the post 16 is aligned with the bore 36 when the beam 18 is located in the notch 26 so that a threaded fastener 40 may pass through the bores 38, 36. As can be seen from FIG. 4, the fastener 40 passes through a part-cylindrical bearing 42 located in the bore 34 and a bearing pad 44. The bearing pad 44 provides a flat surface against which a washer 46 and nut 48 can bear to secure one end of the fastening member 40.

The opposite end of the fastening member 40 is secured by a nut 50 and washer 52 bearing against the vertical face of the post 16.

Figure 2:
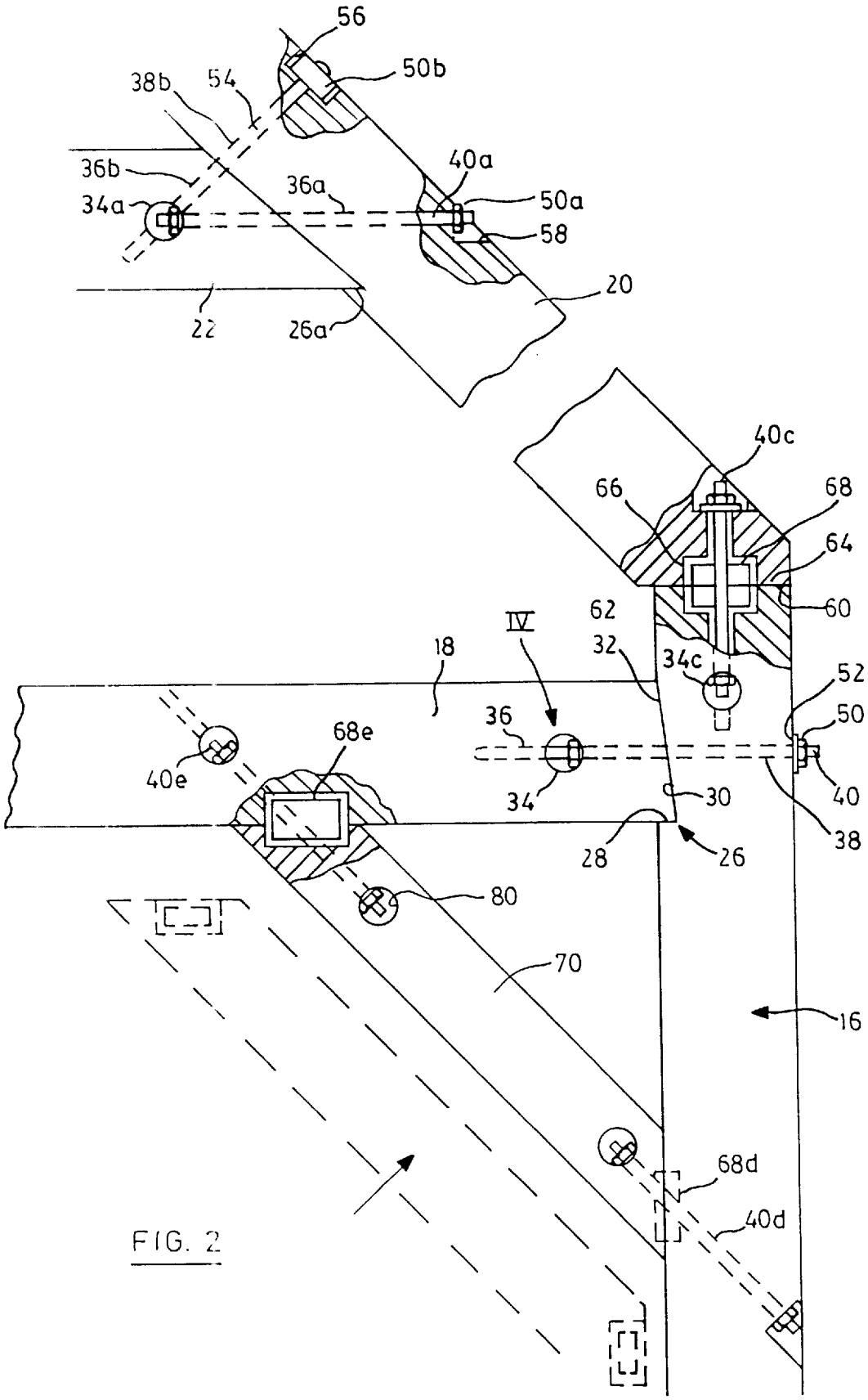
FIG. 2 is a sectional view on the line 2—2 of FIG. 1.

It will be noted from FIG. 2 that a similar structure is utilized to connect the tie rod 22 to the rafter 20, including a notch 26*a* in the rafter 20. Fastener 40*a* is positioned in a bore 36*a* on the longitudinal axis of the cross tie 22 and so is inclined to the rafter 20. To provide the requisite structural strength, a second fastener 54 is located in a pair of bores 36*b*, 38*b* that are angularly offset from but intersect the transverse bore 34*a*. The fastener 54 extends generally normal to the longitudinal axis of the rafter 20 and the rafter 20 is notched as indicated at 56, 58 to recess the retaining nuts 50*a*, 50*b* for the fasteners 40*a*, 54. A pair of bearing pads are provided in the bore 34*a* to receive respective fasteners 40*a*, 50.

A similar arrangement is used to secure the rafter 20 to the post 16 utilizing a fastener 40*c* extending along the longitudinal axis of the post 16 and intersecting the transverse bore 34*c*. The upper end 60 of the post 16 is formed with a cylindrical recess 62 and the lower end 64 of rafter 20 is similarly formed with a recess 66. A cylindrical split ring 68 is located in the recesses 62, 66 so as to project across the junction between the rafter 20 and post 16 and thereby transfer horizontal shear loads between the rafter and the post. The split ring 68 is of known construction comprising a thin-walled cylindrical member which need not be described further as it is well known to those skilled in the art.

The shear stiffness of the post and beam structure is enhanced by a diagonal brace 70 which is connected to the post 16 by fastener 40*d* and to the beam 18 by fastener 40*e*. Split rings 68*d* and 68*e* respectively are located between the ends of the brace 70 and the post 16 and beam 18 but their location within the brace 70 requires a different implementation as shown in FIG. 3.

Figure 3:
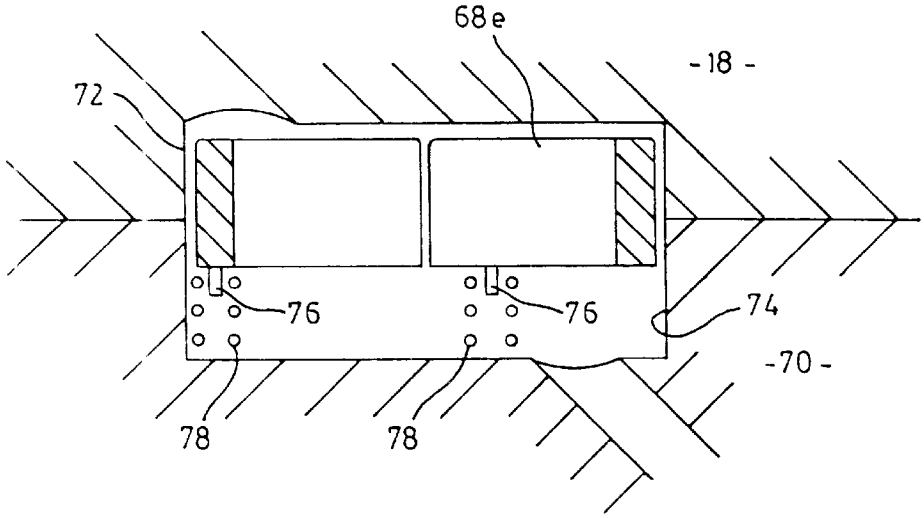
FIG. 3 is an enlarged sectional view of a portion of the structure shown in FIG. 2.

Referring therefore to FIG. 3, it will be seen that the beam 18 and brace 70 are formed with respective recesses 72, 74. The recesses 72, 74 have a diameter to snugly receive the split ring 68*e*. The recess 72 has a depth corresponding to approximately one-half of the height of the split ring 68*e* whereas the recess 74 has a depth corresponding to the full height of the split ring 68*e*. The split ring may therefore be received within the recess 74 and flush with the end of the brace 70.

Circumferentially spaced pins 76 project from the lower edge of the split ring 68*e* to locate a respective coil spring 78. The coil springs bear against the base of the recess 74 and thus bias the split ring 68*e* out of the recess 74.

Accordingly, after assembly of the beam 18 on the post 16, the split rings 68*e*, 68*d* may be positioned within the respective recesses 74. The rings 68*d*, 68*e* may be held flush with end of the brace 70 which is positioned until the recesses 72, 74 are aligned. At that time, the split ring 68*d*, 68*e* will move into the recess 72 under the action of the respective spring 78 and be positioned to bridge the junction between the brace 70 and the post 16 and beam 18 respectively. The respective fasteners 40*e*, 40*d* may then be secured. The fasteners 40*d*, 40*e* may pass through the centre of the split rings to facilitate assembly.

A similar technique is used to secure the post 16 to the foundation 23. Referring to FIG. 10, plate 25 has a threaded stud 40*f* which is received in a central bore 36*f* in the post 16. A transverse bore 34*f* intersects the central bore 36*f* and accommodates bearing pad 44*f* and bearing 42*f*. A nut 50*f* secures the plate 25 to the post 16.

The plate 25 is dimensioned to project laterally to one side of the post 16 and has a pair of holes 27 to receive lag bolts 29 that extend into the foundation 23. The lateral projection of the plate 25 thus permits the post 16 to be adjusted on the foundation 23 and subsequently secured by the log bolts 29 in the correct position.

Once the frame of the building structure has been assembled, the joints between the structural members may be tightened by tightening the nuts 48, 50 on their respective fastening members 40. During construction, the nuts 50 will be accessible and can therefore be readily tightened. As the nuts 50 are tightened, the axial load is applied through the fastener 40 and bearing 42 into the beams 18, 22. The forces are applied along the longitudinal axis with the bearing pad 44 distributing the load into the beam. The forces are applied in the direction of the grain of the lumber which is therefore able to withstand the loading. The transverse bore 34 may also be positioned a sufficient distance from the end face of the beam to avoid splitting of the lumber as the loads are applied.

After assembly, each of the transverse bores 38 may be closed with a plug indicated at 80 so that the fasteners 40 are hidden and the aesthetic appeal is maintained. However, if it becomes necessary to retighten the structure, due, for example, to shrinkage in the posts and beams, then the plugs may be removed and the nuts 48 accessed through the transverse bores The bores 38 are of course sized to permit access of a wrench and in some instances it may be preferred to install a speed wrench within the bore 38 at the time of assembly so that it is simply necessary to remove the plug 80 and access the ratchet mechanism with a lever to tighten the joint.

Figure 5:
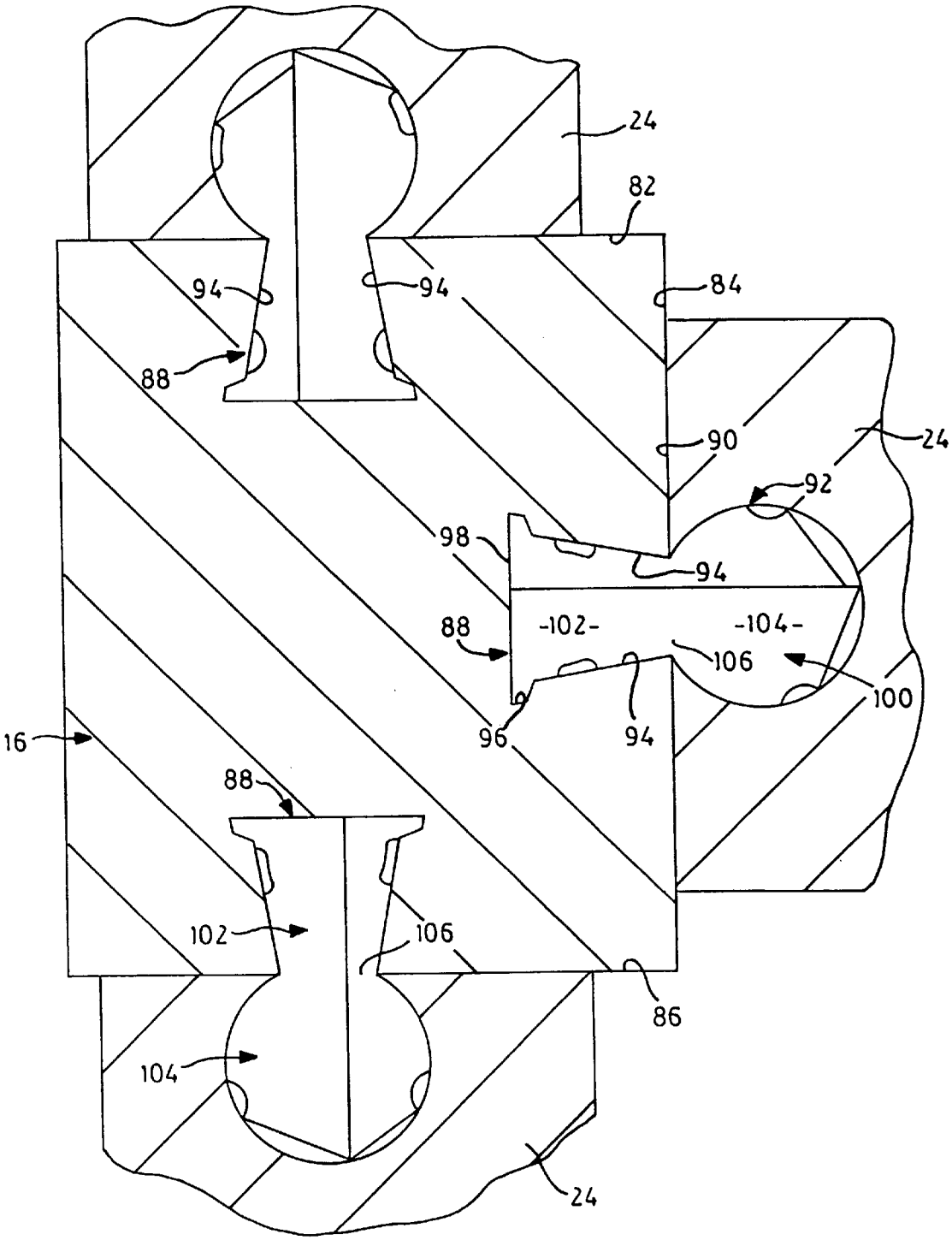
FIG. 5 is a view on the line 5—5 of FIG. 1.

The connection of the logs 24 to the posts 16 is illustrated in FIG. 5. As indicated in FIG. 5, logs 24 abut faces 82, 84, 86 of the posts 16 although it will be understood that alternative configurations and sections of posts may be selected according to the particular configuration of building.

The logs 24 are arranged to be stacked one above the other and abutting faces of the logs are provided with interengaging formations and sealing strips to provide a weathertight seal between the logs. Such formations and configurations of logs are known in the art and a particularly beneficial example is shown in U.S. Pat. No. 5,020,289 issued Jun. 4, 1991, the contents of which are incorporated by reference. As such, further details of the interface between the logs is not believed to be necessary.

Each of the logs 24 has an end face 90 to abut a respective one of the faces 82, 84, 86 on the posts 16. Each of the posts 16 has a dovetail slot 88 extending parallel to the longitudinal axis on each of the faces of the posts to which a log member is attached and aligned with the longitudinal axis of the logs 24. The slot 88 has a pair of diverging flanks 94 that extend from the face 82, 84, 86 to outwardly flared terminal portions 96 adjacent a base 98 of the respective slot 82. A part-cylindrical recess indicated generically at 92 is provided in each of the end faces 90 in a position such that it is aligned with the dovetail slot 82 in the respective face of the posts 16. The intersection of the cylindrical recess 92 with the end face 90 provides an opening corresponding in width to that of the dovetail slot 82 in the face of the posts 16.

The log 24 is secured to the posts 16 by a key 100. In cross section, the key 100 has a complementary shape to the void defined by the slot 88 and recess 92 and so has a pair of reentrant formations 102, 104 interconnected at a waist 106 disposed at the junction between the log 24 and the post 16.

Figure 6:
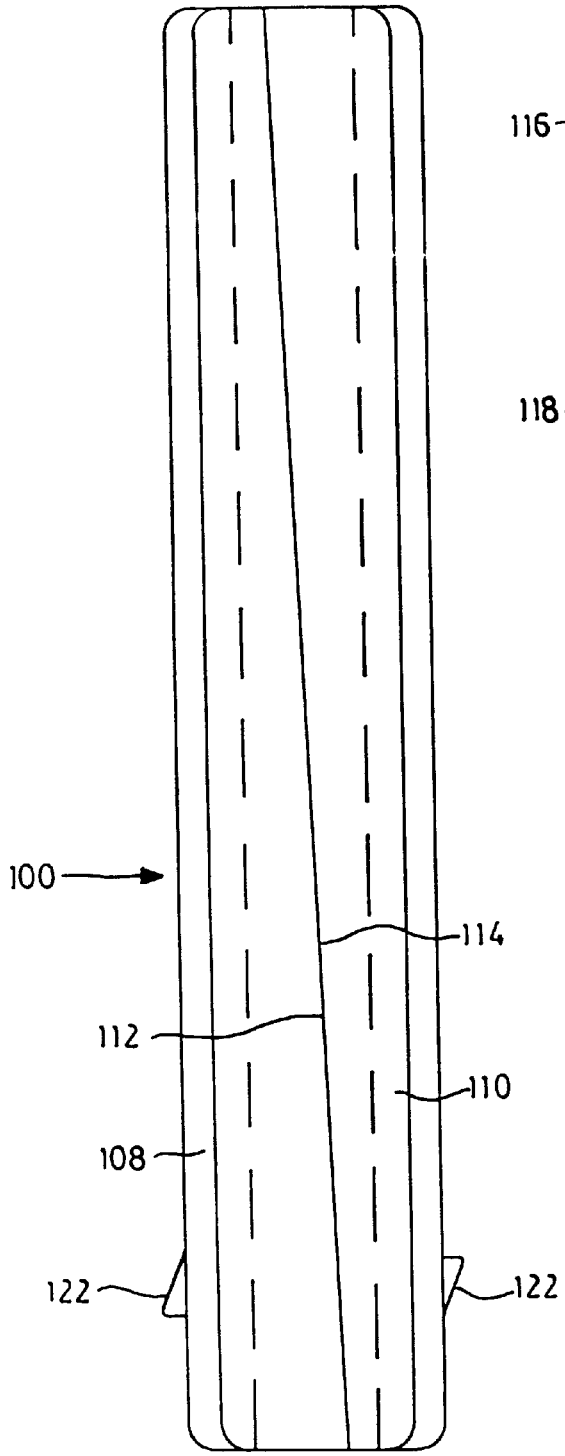
FIG. 6 is a front elevation of a key member shown in situ in FIG. 5.
Figure 7:
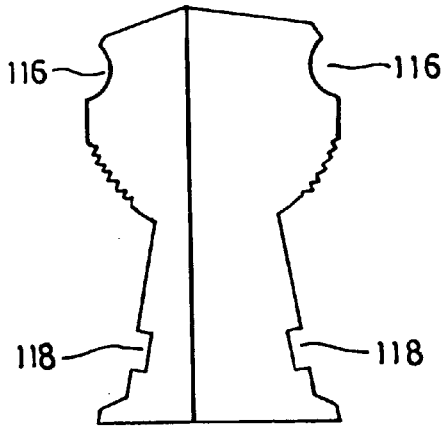
FIG. 7 is an end view of the key member shown in FIG. 6.
Figure 8:
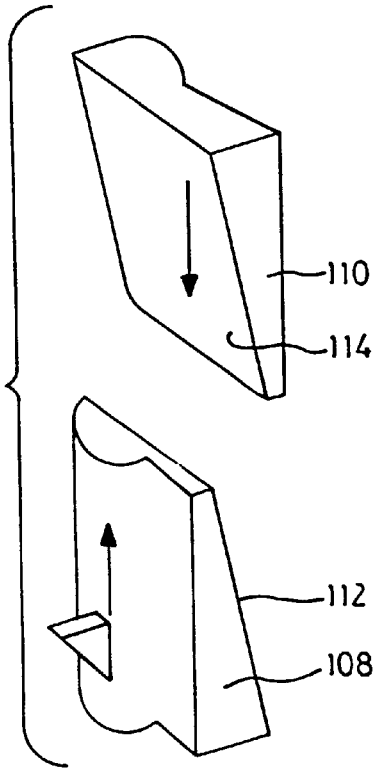
FIG. 8 is an exploded view showing the operation of the key member of FIGS. 6 and 7.

As can best be seen in FIGS. 6, 7 and 8, the key 100 is formed from a pair of wedges 108, 110 that abut along opposed inclined surfaces 112, 114. Relative movement between the wedges 108, 110 varies the lateral dimension of the key 100 so as to fit snugly in the slot 82 and recess 92.

Figure 9:
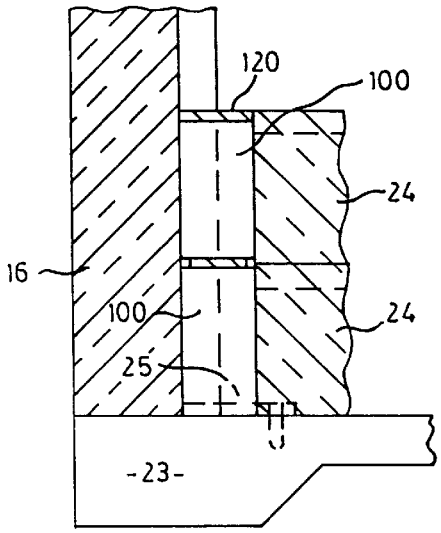
FIG. 9 is a sectional view of a portion of wall on the line 9—9 of FIG. 1.

The outer surfaces of the key 100 is provided with recesses 116, 118 to receive caulking and provide a seal between the slot 88 and recess 92 and the key 100. As can be seen from FIG. 9, a gasket 120 having a similar shape to that of the cross section of the key 100 is positioned between adjacent keys to complete the seal between the logs and post.

In order to secure the log 24 to the posts 16, the log is aligned with the posts 16 such that the recess 92 and slot 88 are in alignment. A wedge 108 is inserted into the recesses such that the inclined face 112 is upwardly directed and the other of the wedge members 110 then inserted so that the faces 112, 114 abut. The wedges 108, 110 may then be driven vertically to cause lateral spreading of the key 100 and a secure fit within the slot 88 and recess 92. Barbs 122 provided on the outer surfaces of the wedges 108, 110 inhibit conjoint movement of the key 100 relative to the log 24 and post 16 to achieve an effective spreading action.

After insertion of the key 100, the gasket 120 is positioned over the key 100 and the next log 24 positioned. The next key 100 may be inserted until the wall is constructed.

The key 100 is preferably formed from a molded plastics material such as polypropylene and can if necessary be cut to length. However, the manufacturer of the slot 88 and recess 92 under controlled factory conditions provides control over the manufacturing tolerances resulting in a good fit between the key 100 and the log 24.

It will be seen therefore that a simple yet effective connection of the logs to the posts is provided with the ability to machine the components during manufacture. Similarly, the connection of the posts and beams permits the components to be manufactured prior to delivery to the site and for adjustment to be made subsequent to assembly.

Figure 11:
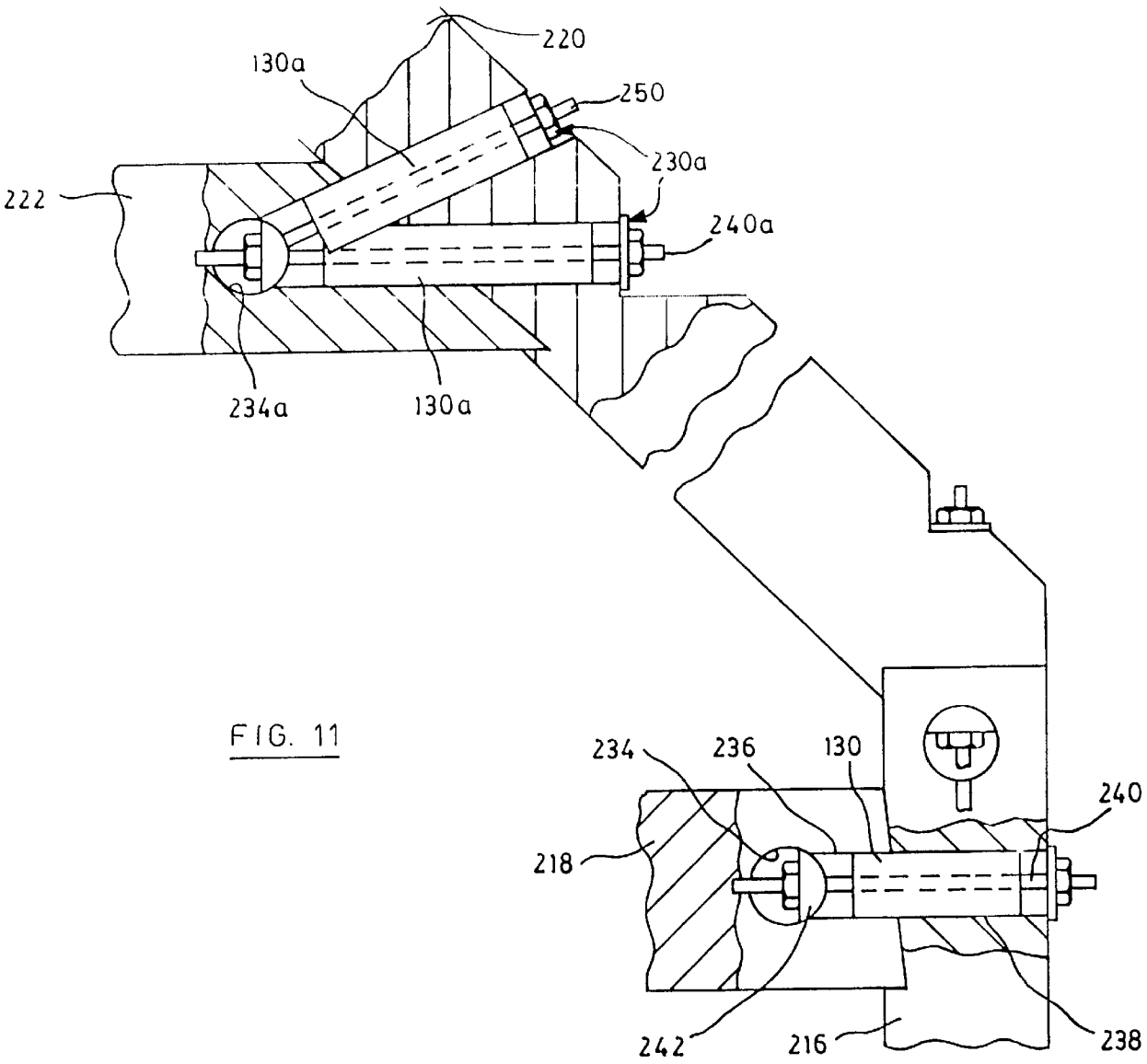
FIG. 11 is a view similar to FIG. 2 of an alternative embodiment of structure.
Figure 12:
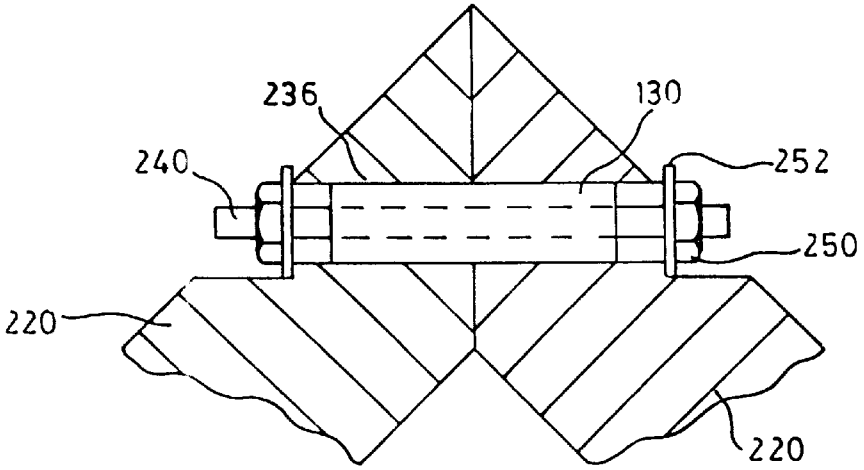
FIG. 12 is a sectional view of a connection between a pair of rafters.
Figure 13:
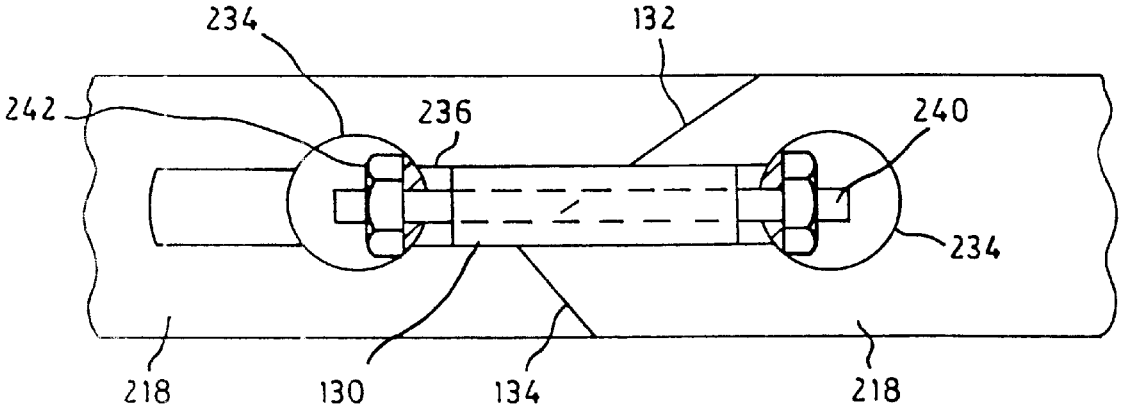
FIG. 13 is a sectional view of a butt joint.

A further embodiment of structural connection is shown in FIGS. 11–13 where like reference numerals will be used to denote like components with a prefix '2' to distinguish between embodiments.

Post 216 is interconnected to the beam 218 with aligned bores 236, 238 provided to receive fastener 240. The bores 236, 238 are of greater diameter than the fastener 240 and receive a tubular insert 130. The insert 130 bridges the intersection of the bores 236, 238 and snugly receives the fastener 240. The insert 130 terminates prior to the part-cylindrical bearing 242 and prior to the vertical face of post 216.

In operation, the tubular insert 130 transfers loads into the beam and post but the foreshortening of the insert 130 permits the fastener 240 to secure the beam and post to one another.

In a typical application, the outer diameter of the insert 130 may be a nominal 1 ¼" with an internal diameter of ¾" to receive a ¾" fastener 240. The bores 236, 238 are also a nominal 1 ¼" so that the insert 130 may be tapped into the bores and maintain them in alignment. A typical installation will have the insert 130 extending approximately 7 inches to each side of the intersection of the post and beam to provide adequate transfer of bending loads into the structural members.

Similar arrangements of inserts 130*a* are utilized at the connection of the tie 222 to the rafter 220. In this case, the inserts 130*a* may terminate adjacent the transverse bore 234*a* to allow each of the fasteners 240*a*, 250 to be received in their respective bearing pads within the bore 230*a*.

A similar arrangement may also be utilized at the ridge of the rafters 220 as shown in FIG. 12. Fastener 240 is received in the insert 130 which itself passes through aligned bores 236. Each end of the fastener 240 is secured by a nut 250 and washer 252 that bears against a vertical face of a notch cut in the upper run of the rafter 220.

A similar arrangement may be utilized in butt joints formed between beams 218 as shown in FIG. 13. In this case, the ends of each of the beams 218 are formed with complementary interengaging surfaces 132, 134 and each has a transverse bore 234. A longitudinal bore 236 is formed in the end of each of the beams 218 to extend from the end surface to intersect the transverse bore 234. Tubular insert 130 is located in the bore and receives the fastener 240. The insert is shorter than the space in between the apertures 234 allowing the fastener 240 to be tensioned by the nut 242.

I claim:

1. A post and beam building structure having a plurality of structural members interconnected to one another to provide a frame of a building, a first of said members having a first bore disposed generally parallel to a longitudinal axis of said member and extending from one end of said member to intersect a transverse bore intermediate the ends thereof, a bearing assembly in said transverse bore with a surface complementary to that of said transverse bore, a second of said members including a second bore aligned with said first bore, a threaded fastener extending along said first and second bores between said first and second members and through said bearing assembly; one end of said fastener being secured to a retainer disposed in said transverse bore and engaging said bearing assembly and the opposite end being secured to said second member whereby a tensile load may be applied to said fastener to urge said members together with said bearing assembly distributing axial loads from said fastener to said first member.

2. A post and beam building structure according to claim 1 wherein said second bore extends through said second member and a second retainer is secured thereto.

3. A post and beam building structure according to claim 2 wherein said second member is notched to receive said one end of said first member.

4. A post and beam building structure according to claim 1 wherein a recess is formed in each of said members and a reinforcement is located in each of said recesses to extend between said members and inhibit relative movement therebetween.

5. A post and beam building structure according to claim 4 wherein said reinforcement is a ring and said fastener passes through said ring.

6. A post and beam building structure according to claim 4 wherein one of said recesses is dimensioned to receive said reinforcement so as to be flush with the surface thereof and resilient elements bias said reinforcement from said one recess toward and into the other of said recesses.

7. A post and beam building structure according to claim 6 wherein said reinforcment is a ring and said fastener passes through said ring.

8. A post and bean building structure according to claim 7 wherein said biasing elements are coil springs circumferentially disposed about said ring.

9. A post and beam building structure having a plurality of vertical posts spaced apart from one another and each having a vertically extending longitudinal axis and a plurality of horizontal wall members extending between adjacent posts and stacked one above the other to provide a wall between said posts, said posts having an undercut recess extending along one face thereof parallel to said longitudinal as of said posts, each of said wall members having an undercut recess in end faces thereof, said end faces abutting respective faces of said posts with said recesses aligned, said wall members and posts being secured to one another by keys received in said recesses and having a periphery complementary to that of said recesses, each of said keys being formed as a pair of wedges having complementary inclined faces such that relative movement between said wedges along the axis of said posts causes expansion of said key to filling said recesses and thereby secure said wall members to a respective one of said posts.

10. A post and beam member according to claim 9 wherein a barb is provided on each of said wedges to inhibit relative movement between said one post and said wedge.

11. A post and beam building structure according to claim 9 wherein one of said recesses is a dovetail having flanks diverging from said face and terminating at apexes.

12. A post and beam building structure according to claim 11 wherein another of said recesses is part cylindrical.

13. A post and beam building structure according to claim 11 wherein terminal portions of said flanks adjacent said apexes are outwardly flared.

14. A post and beam building structure according to claim 13 wherein a sealing membrane is located in said recesses between adjacent ends of said keys.

15. A post and beam building structure having a plurality of structural members interconnected to one another to provide a frame of a building, a first of said members having a first bore disposed generally parallel to a longitudinal axis of said member and extending from one end of said member, a second of said members including a second bore aligned with said first bore, a tubular insert located in said first and second bores and extending between said first and second members, a threaded fastener extending through said tubular insert between said first and second members, one end of said fastener being secured to said first member and an opposite end being secured to said second member whereby a tensile load may be applied to said fastener to urge said members together.

16. A post and beam structure according to claim 15 wherein said first member includes a transverse bore intermediate the ends thereof and intersecting said first bore, said tubular insert is being positioned in said first bore to terminate prior to said transverse bore and a retainer is located in said transverse bore and secured to said fastener.

17. A post and beam building structure according to claim 16, wherein said second bore extends through said second member and a second retainer is secured to said threaded fastener.

18. A post and beam building structure according to claim 17 wherein said second member is notched to receive said one end of said first member.

19. A post and beam building structure according to claim 16 wherein an insert is provided in said transverse bore with a surface complementary to that of said transverse bore and said fastener extends therethrough, said insert being disposed between said retainer and said traverse bore to distribute axial loads from said fastener to said first member.

* * * * *